US008933353B2

(12) United States Patent
Finger et al.

(10) Patent No.: US 8,933,353 B2
(45) Date of Patent: Jan. 13, 2015

(54) FOOT-OPERATED SWITCH

(75) Inventors: Markus Finger, Minden (DE); Michael Schnitker, Uchte (DE); Klaus Wehmeyer, Herford (DE)

(73) Assignee: Bernstein AG, Porta Westfalica (DE)

( * ) Notice: Subject to any disclaimer, the term of this patent is extended or adjusted under 35 U.S.C. 154(b) by 364 days.

(21) Appl. No.: 13/504,165

(22) PCT Filed: Oct. 27, 2010

(86) PCT No.: PCT/EP2010/006552
§ 371 (c)(1),
(2), (4) Date: Apr. 26, 2012

(87) PCT Pub. No.: WO2011/054466
PCT Pub. Date: May 12, 2011

(65) Prior Publication Data

US 2012/0211337 A1 Aug. 23, 2012

(30) Foreign Application Priority Data

Oct. 27, 2009 (DE) ..... 20 2009 013 648 U

(51) Int. Cl.
*H01H 3/14* (2006.01)
*H01H 21/26* (2006.01)

(52) U.S. Cl.
CPC *H01H 3/14* (2013.01); *H01H 21/26* (2013.01)
USPC ..... 200/86.5; 200/553

(58) Field of Classification Search
CPC ..... H01H 3/14; H01H 21/24; H01H 21/26
USPC ..... 200/86.5, 553
See application file for complete search history.

(56) References Cited

U.S. PATENT DOCUMENTS

| | | | | |
|---|---|---|---|---|
| 2,957,960 | A | 10/1960 | Ginn | |
| 4,172,217 | A | 10/1979 | Miller | |
| 4,455,466 | A * | 6/1984 | Wilson | 200/86.5 |
| 5,894,762 | A | 4/1999 | Arao et al. | |
| 6,274,832 | B1 * | 8/2001 | Tachibana | 200/343 |
| 2002/0079204 | A1 | 6/2002 | Overstreet | |
| 2006/0272122 | A1 * | 12/2006 | Butler et al. | 15/383 |
| 2008/0173124 | A1 | 7/2008 | Thiel et al. | |

FOREIGN PATENT DOCUMENTS

| | | |
|---|---|---|
| DE | 2001 19 995 | 4/2001 |
| DE | 203 12 016 | 11/2003 |
| DE | 10 2005 029 458 | 12/2006 |
| EP | 0 515 331 | 11/1992 |

* cited by examiner

*Primary Examiner* — Amy Cohen Johnson
*Assistant Examiner* — Marina Fishman
(74) *Attorney, Agent, or Firm* — Whitham Curtis Christofferson & Cook, PC

(57) ABSTRACT

A switch (1), in particular a foot-operated switch, with a housing (2), in which a switching device (4) is arranged, wherein a leadthrough with a bearing (6) is provided on opposite sides of the housing (2), and a pivotable pedal (3) can be fixed to the bearings (6). The pedal (3) can be positioned removably on the bearings (6) and, in the state in which it is positioned on the bearings (6), can be secured on the bearings (6) in each case via at least one connecting element (12).

8 Claims, 2 Drawing Sheets

FOOT-OPERATED SWITCH

FIELD OF THE INVENTION

The present invention relates to a switch, in particular a foot-operated switch, with a housing, in which a switching device is arranged, wherein a leadthrough with a bearing is provided on opposite sides of the housing, and a pivotable pedal is fixed to the bearings.

BACKGROUND OF THE INVENTION

There are foot-operated switches in which internal electrical switching elements are actuated by means of a pivotable pedal. By virtue of the foot actuation, traces of use in the form of scratches or areas where the paint has split off can arise on the pedal. In addition, other wear phenomena can also occur which reduce the life.

DE 203 12 016 U1 discloses a foot-operated switch with a housing and a lever-like actuating element, which, together with its mechanical bearing, is configured as an assembly which can be detached from the housing.

DE 200 19 995 U1 has disclosed a multifunction foot-operated switch, in which foot pedals are mounted rotatably on a rotary spindle and actuate an associated micro switch in the event of a tipping movement.

Even in the case of the foot-operated switch known from DE 10 2005 029 458 A1, the bearing of the pedals is decoupled from the switch actuation by the pedal.

SUMMARY OF THE INVENTION

The object of the present invention is therefore to provide a switch, in particular a foot-operated switch, which provides the possibility of replacing the pedal.

According to the invention, in the case of the switch the pedal is positioned (reversibly) removably on the bearings and secured in each case via at least one connecting element. Then, the pedal and the bearings form a rigidly interconnected unit, with the result that the bearings move relative to the housing on actuation of the pedal. As a result, the pedal can be replaced for cleaning purposes or for renewal purposes without the housing, the bearings mounted pivotably on the housing and the switching device likewise needing to be replaced. This extends the life and simplifies handling. In particular in the case of switches in which a large number of pedals are fitted to one housing, damage to a pedal does not yet result in permanent failure of the entire switch. Instead, the damaged pedal can be replaced in a simple manner, with the result that the switch then remains functional.

Switching device is understood to mean in particular switches, pushbuttons, dimmers or similar devices which output control signals or voltage potentials for power supply continuously or stepwise on actuation of the pedal.

Preferably, each bearing has a projection, onto which a holder for the pedal is plugged. This simplifies fitting of the pedal. In this case, the projection can be in the form of a strip, with the result that the pedal is pushed onto the projection. Owing to the strip-shaped formation, a holder for the pedals which is positioned in substantially form-fitting fashion can be realized, with the result that relatively high forces can also be transmitted. In order to improve the fixing of the pedal on the projection, the projection can in this case widen in the form of a wedge, preferably towards the free end, with the result that a form-fitting connection is produced.

In accordance with a preferred configuration, the connecting element is in the form of a screw, for example a grub screw, which is screwed into the projection and the holder. As a result, a particularly stable connection between the pedal with the holders and the bearing is produced. The pedal can in this case be formed integrally with the two holders, which enclose the housing in the form of a U.

DESCRIPTION OF THE DRAWINGS

The invention will be explained in more detail below using an exemplary embodiment with reference to the attached drawings, in which.

DETAILED DESCRIPTION

Figure 1:
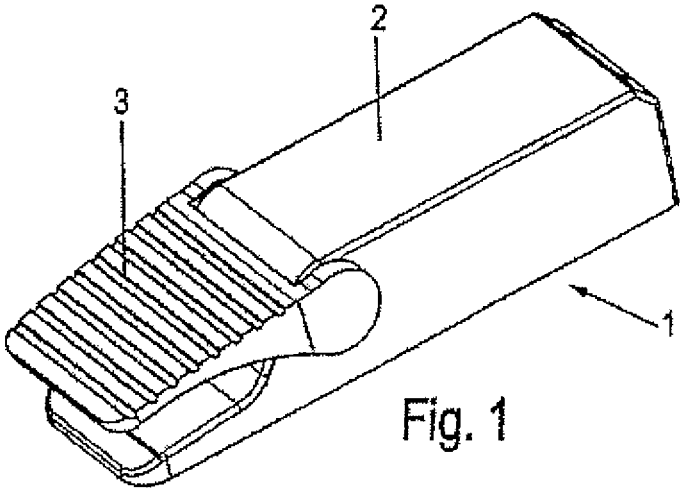
FIG. 1 shows a perspective view of a switch according to the invention.
Figure 2:
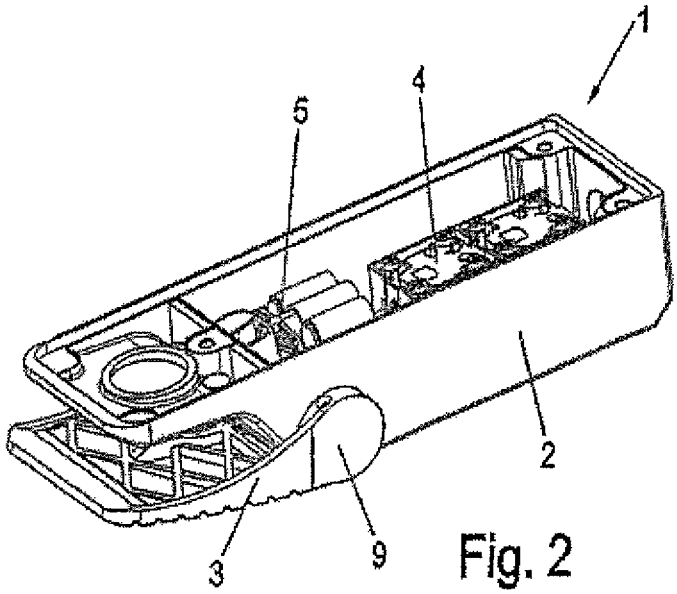
FIG. 2 shows a perspective view of the switch shown in FIG. 1 without a base.
Figure 3:
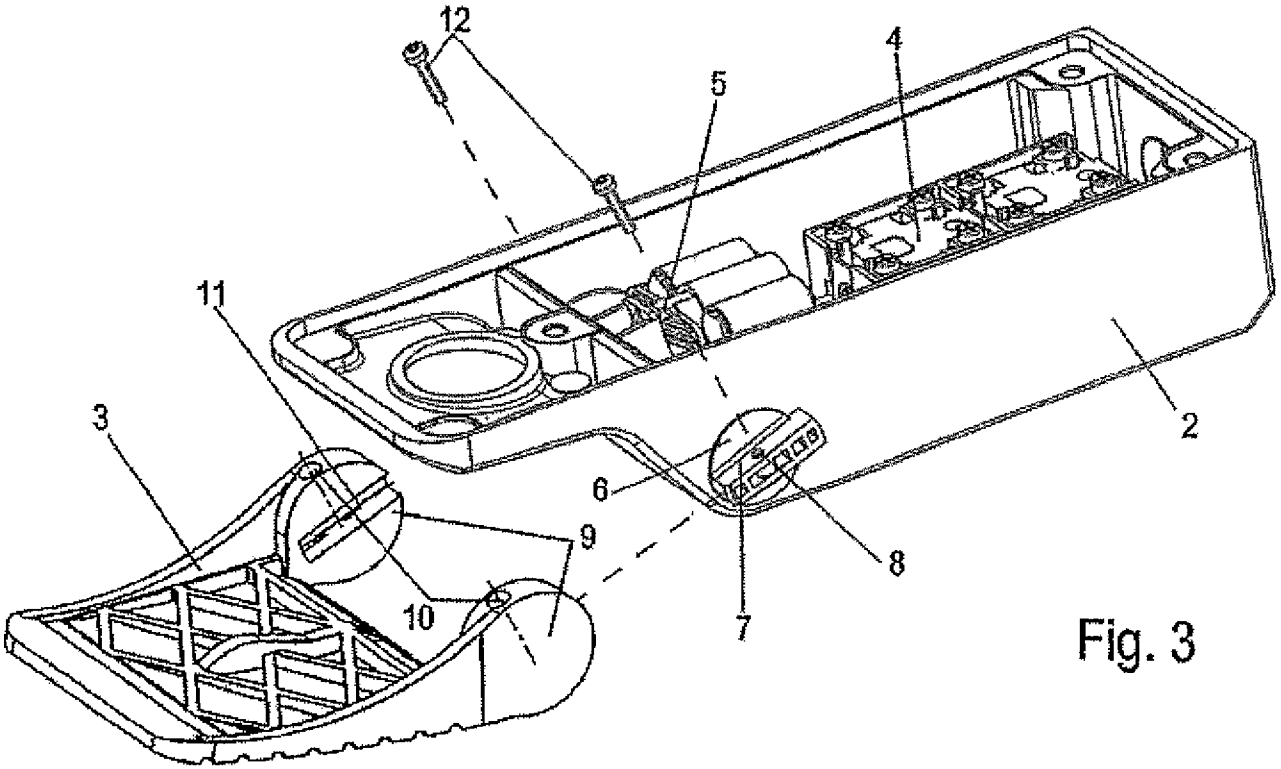
FIG. 3 shows an exploded illustration of the switch shown in FIG. 1.

A switch 1 is in the form of a foot-operated switch and comprises a housing 2, on which a pedal 3 is mounted pivotably. It is naturally also possible to provide a multiplicity of pedals 3 on a housing 2.

The housing 2 is substantially in the form of a box and comprises in each case one leadthrough on opposite sides, with a disk-shaped bearing 6 being arranged on said leadthrough. The bearings 6 are mounted rotatably in the respectively associated leadthrough and are built into the leadthrough in such a way that they are not easily removable. A strip-shaped projection 7 protrudes from the bearing 6, and a threaded opening 8 is formed in said projection.

A switching device 4, which is coupled via a mechanism 5 to the pedal 3, is arranged in the interior of the housing 2. By virtue of the pedal 3 being pivoted, the switching device 4 can be actuated via the bearings 6. The bearings 6 are in this case operatively connected to the switching device 4 in such a way that the switching device 4 is actuated in the case of defined pivoting of the bearings 6 with the aid of the pedal 3. The housing 2 can in this case be sealed off from the outside, in particular when the switch 1 is used in hygienic environments, such as operating theatres, or in humid environments.

In order to fit the pedal 3 replaceably (reversibly and without destruction) on the housing 2, two holders 9 are formed spaced apart from one another and integrally with the pedal 3, said holders engaging around the housing 2, partially in the form of a U. A receiving channel 11 is formed on each holder 9, it being possible for said receiving channel to be pushed onto the strip-shaped projection 7. A screw opening 10 is formed perpendicular to the longitudinal axis of the receiving channel 11, and a screw 12 as connecting element can be screwed into said screw opening. The contour of the receiving channels 11 is matched to the contour of the associated projection 7.

In order to fit the pedal 3, the holders 9 with the slot-shaped channels 11 are plugged onto the two projections 7 of the bearings 6. Then, the screws 12 are screwed through the screw openings 10 into the threaded opening 8 in the projection 7 and fixed there.

In the exemplary embodiment shown, the pedal 3 is pushed onto the projections 7 on the bearings 6. It is also possible to provide other connecting elements for connecting the pedal 3 to the bearing 6, in particular latching or clamping devices can also be used.

The invention claimed is:

1. A foot-operated switch, comprising:

a housing in which a switching device is arranged;

disk-shaped bearings provided on opposite side walls of the housing;

at least one pivotable pedal removable from and fixable to the disk-shaped bearings via at least one connecting element at each disk-shaped bearing;

a projection in the form of a strip positioned on each disk-shaped bearing, wherein the housing has a leadthrough on each of the opposite side walls of the housing, wherein one disk-shaped bearing of said disk-shaped bearings is installed and mounted rotatably at each leadthrough, wherein the at least one pivotable pedal has a pair of holders pluggable to the projection on each disk-shaped bearing, and wherein at least one disk-shaped bearing is coupled to the switching device arranged in the housing.

2. The foot-operated switch of claim 1 wherein the projection widens in the form of a wedge towards one end.

3. The foot-operated switch of claim 1, wherein the at least one connecting element is in the form of a screw which can be screwed into the projection and the holder.

4. The foot-operated switch of claim 1, wherein the pedal is formed integrally with the pair of holders.

5. The foot-operated switch of claim 1, wherein the disk-shaped bearings are connected to one another via a shaft.

6. The foot-operated switch as claimed in claim 5, wherein the shaft has an actuating arm operatively connected to the a switching device arranged in the housing.

7. A switch, comprising:

a housing in which a switching device is arranged;

disk shaped bearings provided on opposite side walls of the housing;

at least one pivotable pedal with two integral holders, the at least one pivotable pedal being removable from and fixable to the disk-shaped bearings via at least one connecting element at each disk-shaped bearing;

a projection in the form of a strip positioned on each disk-shaped bearing, wherein the housing has a leadthrough on each of the opposite side walls of the housing, wherein one disk-shaped bearing of said disk-shaped bearings is installed and mounted rotatably at each leadthrough, wherein the projection on each disk-shaped bearing is connectable to one of the two integral holders by sliding the projection into a slot in the holder, and wherein at least one disk-shaped bearing is coupled to the switching device arranged in the housing.

8. A switch, comprising:

a housing in which a switching device is arranged;

disk-shaped bearings provided on opposite side walls of the housing;

a shaft connecting the disk-shaped bearings provided on opposite side walls of the housing, the shaft passing through the housing;

at least one pivotable pedal with two integral holders, the at least one pivotable pedal being removable from and fixable to the disk-shaped bearings via at least one connecting element at each disk-shaped bearing;

wherein the housing has a leadthrough on each of the opposite side walls of the housing, wherein one disk-shaped bearing of said disk-shaped bearings is installed and mounted rotatably at each leadthrough and seals up the leadthrough at each of the opposite side walls, wherein each disk-shaped bearing has a projection onto which one holder of the two integral holders is pluggable, wherein the shaft has an actuating arm operatively connected to the switching device arranged in the housing.

* * * * *